US009814279B2

(12) United States Patent
Ho

(10) Patent No.: US 9,814,279 B2
(45) Date of Patent: Nov. 14, 2017

(54) INTEGRALLY FORMED SAFETY HELMET STRUCTURE

(71) Applicant: Chang-Hsien Ho, Tainan (TW)

(72) Inventor: Chang-Hsien Ho, Tainan (TW)

( * ) Notice: Subject to any disclaimer, the term of this patent is extended or adjusted under 35 U.S.C. 154(b) by 133 days.

(21) Appl. No.: 14/932,081

(22) Filed: Nov. 4, 2015

(65) Prior Publication Data

US 2016/0095375 A1 Apr. 7, 2016

Related U.S. Application Data

(63) Continuation-in-part of application No. 14/048,134, filed on Oct. 8, 2013, now Pat. No. 9,210,962.

(51) Int. Cl.

| | |
|---|---|
| ***A42B 3/00*** | (2006.01) |
| ***A42B 3/12*** | (2006.01) |
| ***A42C 2/00*** | (2006.01) |

(52) U.S. Cl.

CPC ..... *A42B 3/128* (2013.01); *A42B 3/124* (2013.01); *A42C 2/002* (2013.01)

(58) Field of Classification Search

CPC ..... A42B 3/128; A42B 3/124; A42B 3/125; A42C 2/002

See application file for complete search history.

(56) References Cited

U.S. PATENT DOCUMENTS

| | | | | |
|---|---|---|---|---|
| 3,447,163 | A * | 6/1969 | Tojeiro | A42B 3/065 2/412 |
| 5,349,893 | A * | 9/1994 | Dunn | F41H 5/04 2/2.5 |
| 5,840,397 | A * | 11/1998 | Landi | A41D 13/05 428/116 |
| 7,601,654 | B2 * | 10/2009 | Bhatnagar | F41H 5/0457 181/292 |
| 7,930,771 | B2 * | 4/2011 | Depreitere | A42B 3/124 2/410 |
| 8,104,593 | B2 * | 1/2012 | Lin | A42B 3/063 188/372 |
| 8,661,572 | B2 * | 3/2014 | Rogers | A42B 3/04 2/410 |
| 2011/0212320 | A1 * | 9/2011 | Greenhill | A42B 3/12 428/313.3 |

* cited by examiner

*Primary Examiner* — Khaled Annis
(74) *Attorney, Agent, or Firm* — Rosenberg, Klein & Lee

(57) ABSTRACT

An integrally formed safety helmet structure includes an assembly of a helmet shell or a shell body, a foam filling body enclosed in the shell body and a structure body. Geometrical array texture structures are disposed at the assembling interfaces between the shell body, the structure body and the foam filling body. In manufacturing, by means of a mold or molding module and solid foaming technique, the foam filling body is integrally formed to bond with the shell body and the structure body and the geometrical array texture structures so as to form a compact and rigid multi-layer complex reinforcement structure. The complex reinforcement structure not only can enhance the structural strength of the entire safety helmet, but also has the advantages of material-saving, lightweight, high security and easy manufacturing.

19 Claims, 6 Drawing Sheets

INTEGRALLY FORMED SAFETY HELMET STRUCTURE

CROSS-REFERENCE TO RELATED APPLICATION

This application is a continuation-in-part application of U.S. patent application Ser. No. 14/048,134, entitled "reinforcement structure of safety helmet and manufacturing method thereof", currently pending.

BACKGROUND OF THE INVENTION

1. Field of the Invention

The present invention relates generally to an integrally formed safety helmet structure, and more particularly to a safety helmet assembly of a foam cushion filling body, a shell body and a structure body. The foam cushion filling body, the shell body and the structure body bond with each other to form an integrated complex reinforcement structure. The complex reinforcement structure not only makes it possible to manufacture the safety helmet in a lighter and more convenient form, but also has the advantage of high security.

2. Description of the Related Art

A conventional safety helmet has a plastic shell body and an anti-impact filling body formed of foam material by means of heat ing the foam material. The plastic shell body tightly encloses and bonds with the foam filling body to form the safety helmet. FIGS. 1 and 2 show a typical conventional safety helmet.

With respect to the structural design and security of the conventional safety helmet, an (EPS) low-density foam filling body B1 is enclosed in a plastic shell A. A high-density foam filling body B2 is further disposed on inner face of the low-density foam filling body B1 to form a complex foam filling body. The external plastic shell A of the helmet mainly serves to resist against the preliminary impact and thrust force of a sharp object and provide a surrounding converging force for the low-density foam filling body B1. In this case, the low-density foam filling body B1 can provide softer and high-contraction force buffering effect to distribute and transmit the impact force. Under such circumstance, after the strong external impact force is spread, the high-density foam filling body B2 with a material property of higher hardness and frangibility can provide sufficient support strength to bear the external impact force. Therefore, the innermost-layer high-density foam filling body B2 is prevented from breaking to lose its protection effect.

It is known that the high-density foam filling body B2 is positioned in a position nearest to a wearer's head. In the case that the density of the high-density foam filling body B2 is increased to enhance the support strength and protection effect of the high-density foam filling body B2, this often leads to uncomfortable feeling of the wearer when wearing the safety helmet.

Therefore, at the current stage, the arrangement of FIG. 1 is often employed to increase the thickness of the external plastic shell A and thus increase the surrounding converging force thereof so as to ensure that the foam filling body (B1 or B2) is sufficiently able to distribute, transmit and bear external impact force without being over-thickened to affect the volume of the helmet. However, as well known by those who are skilled in this field, when thickening the plastic shell, not only the material cost is increased, but also the total weight of the helmet body is increased and the burden on the wearer is increased. As a result, the wearer will feel uncomfortable when wearing the safety helmet.

In order to improve the above problem, FIG. 2 shows another conventional safety helmet. In this safety helmet, a soft shock-absorbing block body C made of ethylene-vinyl acetate copolymer (EVA) is disposed between the plastic shell A and the foam filling body B. Under such circumstance, a shock-absorbing cushion space D is defined between the plastic shell A and the foam filling body B. By means of the block body C, the space D provides an auxiliary shock-absorbing and cushioning effect to protect the foam filling body B. Accordingly, the external impact force is prevented from directly reaching the foam filling body B to destroy the buffering, distribution and transmission effect of the foam filling body B.

It should be noted that in the conventional safety helmet of FIG. 2, it is necessary to manually adhere or assemble the plastic shell A, the foam filling body B and the block body C layer by layer. Therefore, not only the material cost and manufacturing cost are higher, but also it is time-consuming to manufacture the safety helmet and the manufacturing process cannot be speeded. Moreover, the block body C, the plastic shell A and the foam filling body B are apt to be adhered to each other in incorrect positions due to human error. This will affect the buffering, distribution and transmission effect of the foam filling body B. This is not what we expect.

Basically, with respect to structural design and manufacturing process, the plastic shell and internal structure body of the above conventional safety helmets have some problems in tests and practical use. Therefore, it is tried by the applicant to redesign the assembling structure of the external plastic shell and the internal foam filling body of the safety helmet to greatly enhance the structural strength of the safety helmet and solve the problems existing in the conventional safety helmet. In the condition that the safety helmet is manufactured in a simple form with high security, the safety helmet of the present invention has a structure different from the conventional safety helmet to provide a full protection and support effect and change the transmission/distribution form of the external impact force (or external action force) so as to eliminate the shortcomings of the conventional safety helmet.

For example, the safety helmet structure of the present invention apparently improves the shortcoming of the conventional safety helmet structure that the internal structure body (or foam filling body) of the conventional safety helmet is unable to effectively distribute and transmit various external impact forces to the respective regions of the helmet body for every part of the safety helmet structure to uniformly bear various impact forces.

The present invention provides a multilayer helmet structure design, which is able to bear various external impact forces. In the helmet structure, the foaming density of the outermost-layer structure is smaller than the foaming density of the middle-layer structure so as to achieve better collapsing and distribution effect. The middle-layer structure has sufficient structural strength or hardness to bear and resist against the distributed impact force without transmitting the impact force directly to the interior of the helmet. In addition, in condition that the innermost-layer structure of the helmet has sufficient strength, the foaming density of the innermost-layer structure is smaller than the foaming density of the middle-layer structure so as to further provide impact force distribution, transmission and absorption effect. This can improve and lower the uncomfortable feeling of a wearer.

In a preferred embodiment, the foaming density of the solid foam granules or materials progressively increases from the regions of the outermost-layer and innermost-layer structures to the region of the middle-layer structure. In addition, the safety helmet assembly has higher structural strength than the conventional safety helmet in all directions or regions so that the safety helmet assembly is able to fully bear external impact or lateral impact pressure. Furthermore, in condition of high security, the safety helmet assembly is designed with a highly lightweight structure to widen the application range of the safety helmet. None of the conventional safety helmets substantially has the advantages of the present invention.

SUMMARY OF THE INVENTION

It is therefore a primary object of the present invention to provide an integrally formed safety helmet structure. The safety helmet structure includes an assembly of a helmet shell or a shell body, a foam filling body enclosed in the shell body and a structure body. Geometrical array texture structures are disposed at the assembling interfaces between the shell body, the structure body and the foam filling body. In manufacturing, by means of a mold or molding module and solid foaming technique, the foam filling body is integrally formed to bond with the shell body and the structure body and the geometrical array texture structures so as to form a compact and rigid multilayer complex reinforcement structure. The complex reinforcement structure not only can enhance the structural strength of the entire safety helmet, but also has the advantages of material-saving, lightweight, high security and easy manufacturing.

In the above integrally formed safety helmet structure, a geometrical array texture structure is disposed on the inner face of the shell body. The geometrical array texture structure of the shell body protrudes from the inner face of the shell body to the geometrical array texture structure of the structure body. The foam filling body encloses or bonds with the geometrical array texture structures of the shell body and the structure body to form an integrated reinforcement structure. In the condition that the entire safety helmet structure is obviously fully able to bear different forms of impacts and has high security, the thickness of the external plastic shell body is greatly thinned to reduce the total weight of the safety helmet. In addition, the present invention improves the shortcomings of the conventional safety helmet that the foam filling body is laboriously and troublesomely adhered to the plastic shell and it often takes place that the foam filling body is adhered to an incorrect position due to human error as well as the manufacturing cost is relatively high.

In the above integrally formed safety helmet structure, the bonding means the foam filling body bonds with the shell body and the structure body or the foam filling body passes through or fills into the geometrical array texture structures of the shell body and the structure body.

In the above integrally formed safety helmet structure, the geometrical array texture structures of the shell body and the structure body have multiple polygonal solid cells connected with each other. (The solid cells of the shell body and the structure body are such as triangular solid cells, hexagonal solid cells as a cellular structure or a texture of circular solid cells). The solid foam granules or materials in the solid cells gradually foam to fill up or bond with or connect with the shell body, the structure body and the foam filling body to form an integrated impact absorption structure. In addition, the density of the foam filling body is larger than the density of the foam cushion material in the geometrical array texture structure of the structure body, and the density of the foam cushion material in the geometrical array texture structure is larger than the density of the foam cushion material in the geometrical array texture structure of the shell body. That is, the shell body, the foam filling body and the structure body bond with each other to form a multiplex system for buffering, absorbing and uniformly distributing and transmitting external impact force.

In the above integrally formed safety helmet structure, at the foaming stage, the geometrical array texture structure of the shell body and the geometrical array texture structure of the structure body will limit the expandable space of the solid foam granules or materials to further affect the foaming distribution density in the texture structures. Accordingly, the foaming density of the solid foam granules or materials progressively increases from the regions of the geometrical array texture structures of the shell body and the structure body to the region of the foam filling body. That is, the foaming density of the solid foam granules or materials gradually varies from the outer and inner layers to the middle layer of the helmet assembly. Accordingly, the multiplex system is set up in the assembly to provide the external impact force buffering, absorbing and uniformly distributing and transmitting effect.

The present invention can be best understood through the following description and accompanying drawings, wherein:

BRIEF DESCRIPTION OF THE DRAWINGS

FIG. 1 is a plane sectional view of the present invention according to FIG. 3, showing that the geometrical array texture structure of the shell body, the foam filling body and the geometrical array texture structure of the structure body bond with each other to form an integrated complex reinforcement structure;

DETAILED DESCRIPTION OF THE PREFERRED EMBODIMENTS

Figure 3:
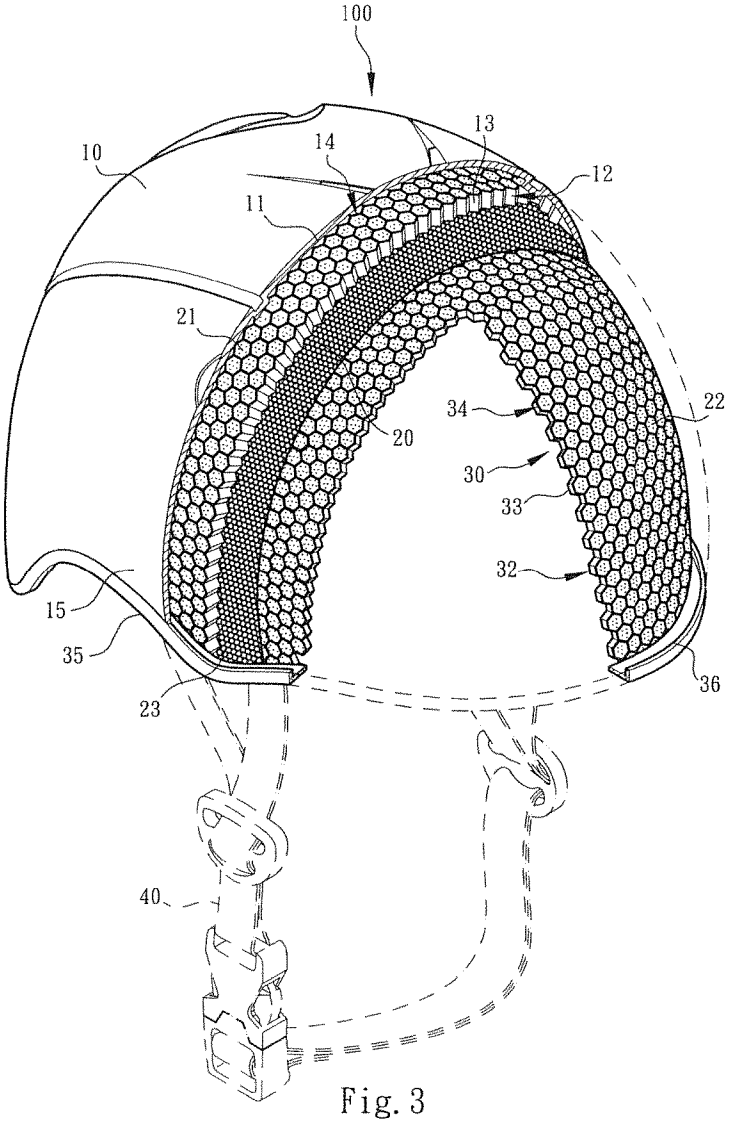
FIG. 3 is a perspective sectional view of the present invention, showing that the shell body, the foam filling body and the structure body bond with each other to form an integrated complex reinforcement structure.
Figure 4:
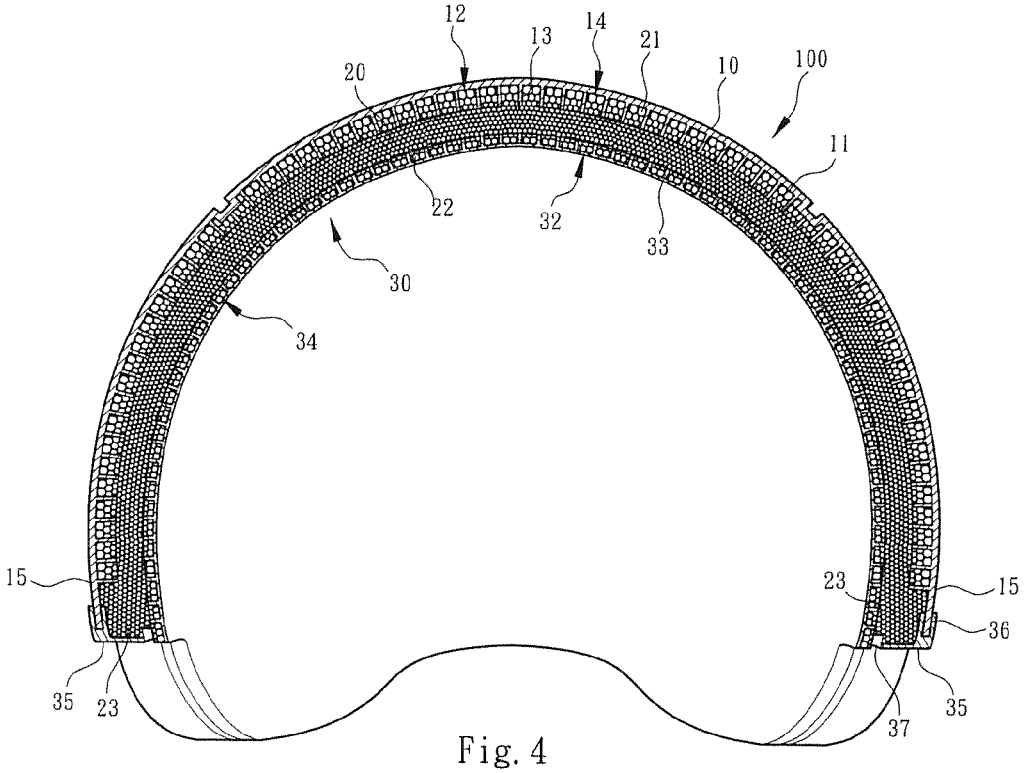
Figure 5:
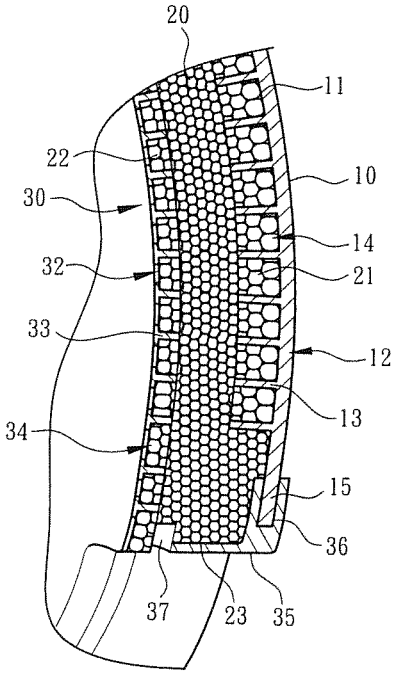
FIG. 5 is an enlarged view of a part of FIG. 4, showing that the foam material in the geometrical array texture structure of the shell body and the foam filling body and the foam material in the geometrical array texture structure of the structure body have different foaming densities.

Please refer to FIGS. 3, 4 and 5. In a preferred embodiment, the integrally formed safety helmet structure of the present invention is selectively a sports helmet. However, alternatively, the safety helmet can be also an open-face or full-face engineering helmet, mountaineering helmet, rider's helmet, bike helmet, motor helmet, ski helmet, etc. The integrally formed safety helmet structure of the present invention includes an assembly of a shell body 10, a foam filling body 20 formed of foam cushion material and a structure body 30. The shell body 10 can be selectively made of plastic material. The shell body 10 has an inner face 11. The foam cushion material has the form of solid foam granules. In a mold or a molding module (not shown), the solid foam granules are heated to expand and combine into the foam filling body 20 and bond with the shell body 10 and the structure body 30 to form an integrated complex structure (or assembly 100). In the assembly 100, the shell body 10 integrally encloses the foam filling body 20 and the structure body 30.

As shown in the drawings, a geometrical array texture structure 12 is disposed on the inner face 11 of the shell body 10. The geometrical array texture structure 12 protrudes from the inner face 11 of the shell body 10 toward the structure body 30. The geometrical array texture structure 12 has multiple walls 13 connected with each other to together define multiple polygonal solid cells 14. The multiple polygonal solid cells 14 can be triangular solid cells, hexagonal solid cells as a cellular structure or a texture of circular solid cells. The cushion foam material can enter the solid cells 14 to foam and fill the solid cells 14 so as to form a foam filling body (or referred to as first subsidiary foam filling body 21). The foam filling body bonds with or connects with the shell body 10 and the structure body 30 to together form an integrated impact absorption structure.

In this embodiment, the structure body 30 is selectively made of plastic material or other similar high-elasticity material. The structure body 30 is a cap-shaped texture in the form of a substantially hemispherical body. The structure body 30 is also formed with a geometrical array texture structure 32. The geometrical array texture structure 32 of the structure body 30 has multiple walls 33 connected with each other to together define multiple polygonal solid cells 34. The multiple polygonal solid cells 34 can be triangular solid cells, hexagonal solid cells as a cellular structure or a texture of circular solid cells. The cushion foam material can enter the solid cells 34 to foam and fill the solid cells 34 so as to form a foam filling body (or referred to as second subsidiary foam filling body 22). The foam filling body bonds with or connects with the shell body 10 and the structure body 30.

Figure 1:
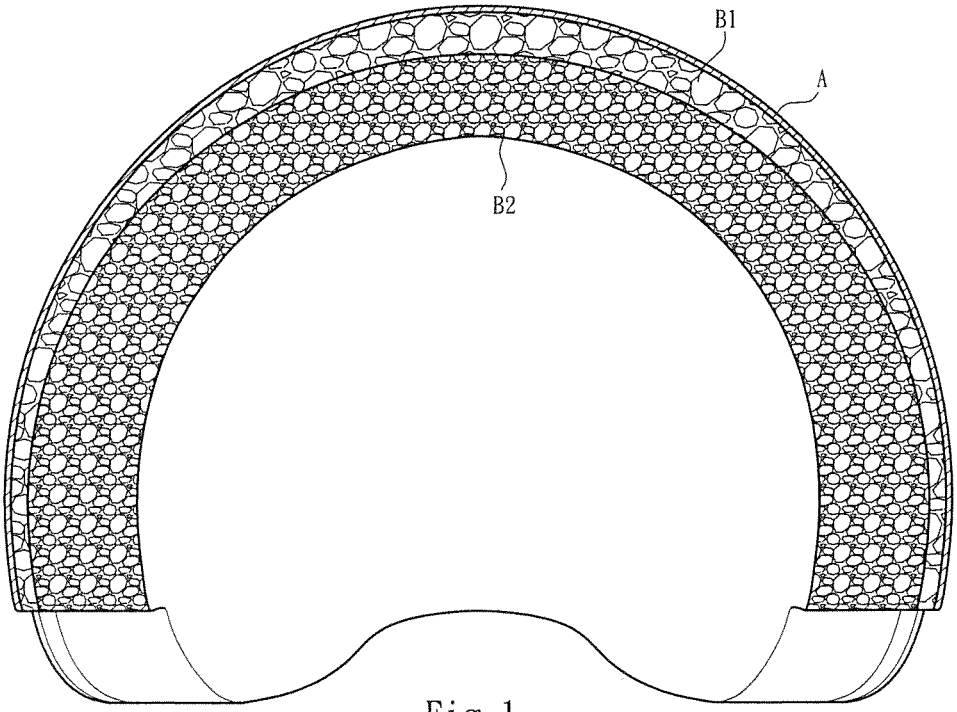
Fig. 1 PRIOR ART
FIG. 1 is a sectional view of a conventional safety helmet, showing that the shell body and the foam filling body bond with each other.
Figure 2:
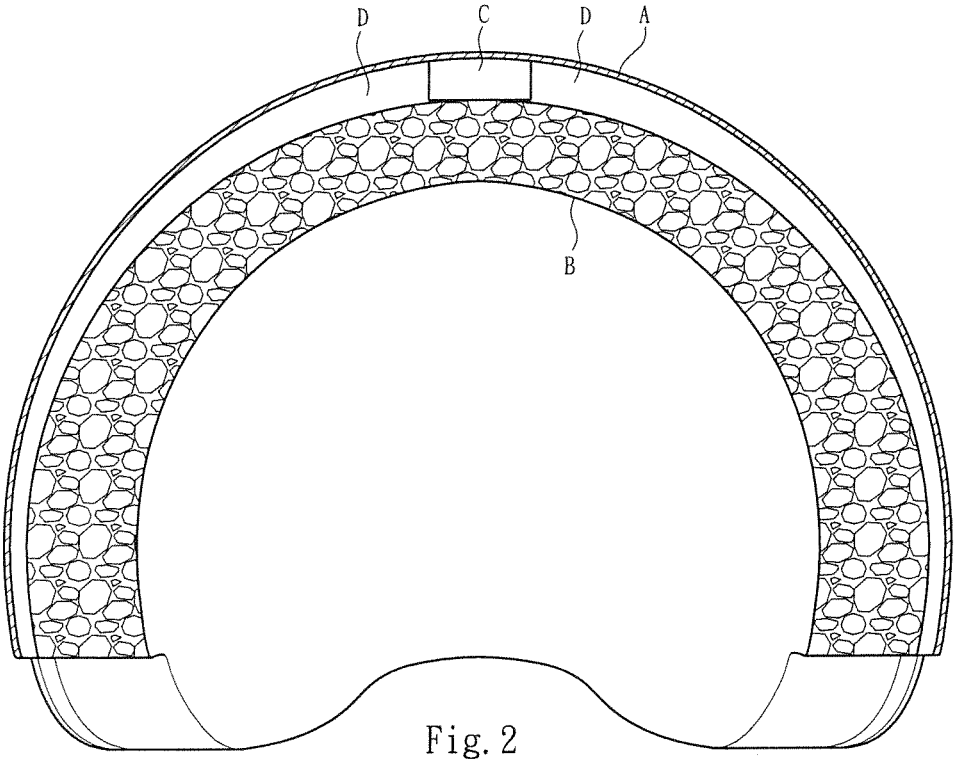
Fig. 2 PRIOR ART
FIG. 2 is a sectional view of another conventional safety helmet, showing that the shell body and the block body and the foam filling body bond with each other.

As shown in FIGS. 1,2 and 3, the geometrical array texture structure 32 of the structure body 30 is directed to the geometrical array texture structure 12 of the shell body 10. That is, the solid cells 14 of the geometrical array texture structure 12 of the shell body 10 are opposite to the solid cells 34 of the geometrical array texture structure 32.

As shown in the drawings, the height of the walls 13 of the geometrical array texture structure 12 (or the depth of the solid cells 14 of the shell body 10) is larger than the height of the walls 33 of the geometrical array texture structure 32 (or the depth of the solid cells 34 of the structure body 30). Therefore, the density of the foam filling body 20 is larger than the density of the cushion foam material (the second subsidiary foam filling body 22) in the solid cells 34 of the structure body 30. The density of the cushion foam material (the second subsidiary foam filling body 22) in the solid cells 34 of the structure body 30 is larger than the density of the cushion foam material (the first subsidiary foam filling body 21) in the solid cells 14 of the shell body 10. That is, the shell body 10, the foam filling body 20 and the structure body 30 together set up a multiplex system for buffering, absorbing and uniformly distributing and transmitting external impact force.

As shown in FIGS. 4 and 5, in this embodiment, at the foaming stage, the geometrical array texture structure 12 of the shell body and the geometrical array texture structure 32 of the structure body 30 will limit the expandable space of the solid foam granules or material to further affect the foaming distribution density in the texture structures 12, 32. Accordingly, the foaming density of the solid foam granules or material progressively increases from the regions of the geometrical array texture structure 12 of the shell body 10 and the geometrical array texture structure 32 of the structure body 30 to the region of the foam filling body 20. That is, the foaming density of the solid foam granules or material progressively increases from the outer and inner layers to the middle layer of the helmet assembly 100. Accordingly, the multiplex system is set up in the assembly 100 to provide the external impact force buffering, absorbing and uniformly distributing and transmitting effect, which is inward progressively enhanced.

It should be noted that not only the height of the walls 13, 33 of the geometrical array texture structures 12, 32 (or the depth of the solid cells 14, 34) will affect the foaming density, but also the numbers of the walls 12, 32 and the sizes and specifications of the solid cells 14, 34 will change the density of the cushion foam material (the first and second subsidiary foam filling bodies 21, 22) in the solid cells 14, 34.

To speak more specifically, when the assembly 100 (including the lateral sides or peripheral region of the assembly 100) is impacted by an external force, the shell body 10 and the geometrical array texture structure 12 thereof in association with the first subsidiary foam filling body 21 in the solid cells 14 can directly resist against and reduce the external impact force. Moreover, the structure body 30, the geometrical array texture structure 32 of the structure body 30, the solid cells 34 of the structure body 30, the second subsidiary foam filling body 22 and the foam filling body 20 together cooperatively forma tightly enclosed complex structure. This not only greatly increases the bonding force between the borders of the foam granules, but also changes the transmission pattern of the external impact force to minimize the possibility of decomposition and breakage of the foam cushion material as in the conventional safety helmet structure.

That is, the geometrical array texture structure 12 of the shell body 10, the first subsidiary foam filling body 21, the foam filling body 20, the geometrical array texture structure 32 of the structure body 30 and the second subsidiary foam filling body 22 serve to directly fully distribute the external impact force and transmit the external impact force to every region of the entire assembly. Under such circumstance, the respective sections of the assembly 100 can uniformly bear the components of the external impact force to minimize the possibility of breakage of the assembly due to concentration of stress.

In comparison with the conventional safety helmet, the structure of the assembly 100 is reinforced and characterized in that not only the assembly 100 is able to bear greater obtuse impact force, but also the geometrical array texture structure 12 of the shell body 10 and the geometrical array texture structure 32 of the structure body 30 can directly increase the bonding force between the borders of the foam granules so that the ability of the assembly 100 to resist against sharp impact is apparently increased. Therefore, the consumed amount or thickness of the foam material and external plastic shell for bearing the impact force can be decreased to greatly reduce the volume and weight of the entire helmet assembly 100 and apparently lower the burden on a wearer.

This is because the geometrical array texture structure 12 of the shell body 10, the structure body 30 and the geometrical array texture structure 32 of the structure body 30 enhance the structural strength of the entire foam cushion material (or foam filling body 20) to fully bear greater external normal impact and compression force (coming from the top section of the helmet assembly 100) or lateral impact and compression force (coming from the lateral sides of the helmet assembly 100) in different forms. Therefore, the additional material of the conventional safety helmet for enhancing the resistance against the external impact can be reduced, thinned or saved.

FIGS. 3, 4 and 5 also show that an annular subsidiary section 35 is formed on the bottom of the structure body 30. The subsidiary section 35 is a structure with a U-shaped cross section to help in increasing the support effect and structure strength of the structure body 30. In addition, the subsidiary section 35 of the structure body 30 serves to more securely fix or locate the structure body 30 in the molding module.

It should be noted that the annular subsidiary section 35 is connected with the bottom of the structure body 30 to form a texture for increasing the structural strength of the integrated structure body 30. Moreover, the annular subsidiary section 35 can provide better power transmission and external force bearing effect. Especially, the form of the structure body 30 with the subsidiary section 35 enables the structure body 30 to provide greater support or bearing strength against lateral impact than the conventional safety helmet. Also, when the foam filling body 20 encloses or bonds with the structure body 30, the foam cushion material is filled in the subsidiary section 35, whereby the subsidiary section 35 encloses the bottom 23 of the foam filling body 20 to form an integrated complex reinforcement structure.

In a preferred embodiment, a fastening strap or fastening device 40 can be directly disposed on the subsidiary section 35 as shown by the phantom lines of FIG. 3. This can improve the shortcoming of the conventional safety helmet that it is necessary to additionally mount a U-shaped bottom frame on the foam filling body for assembling with the fastening device.

Further referring to FIGS. 4 and 5, the subsidiary section 35 is formed with an insertion channel 36 for fixedly holding the bottom edge 15 of the shell body 10. In addition, a recess 37 is formed between the inner side of the bottom of the structure body 30 (or the inner side of the subsidiary section 35) and the foam filling body 20. A protective strip or decorative strip (not shown) can be mounted in the recess 37. The inner side means a direction or a position directed to the interior of the assembly 100.

Figure 6:
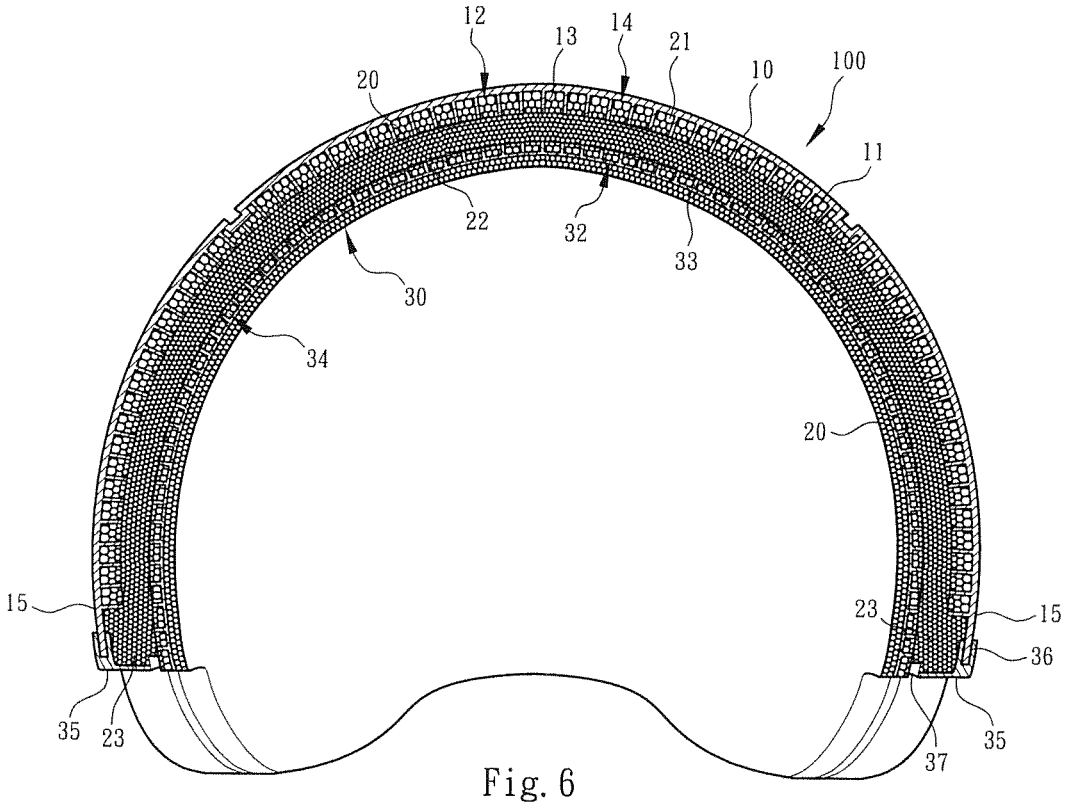
FIG. 6 is a sectional view of another embodiment of the present invention, showing that the foam filling body encloses the structure body.

As shown in the drawings, the structure body 30 is positioned in an innermost side or innermost layer position of the assembly 100 or the foam filling body 20. Accordingly, the foam filling body 20 is restricted within the range between the shell body 10 and the structure body 30 or encloses the structure body 30 as shown in FIG. 6. When an external sharp object impacts the assembly 100, such arrangement prevents the foam filling body 20 from breaking apart. Moreover, after the shell body 10, the geometrical array texture structure 12, the first subsidiary foam filling body 21 and the foam filling body 20 provide preliminary buffering and absorption effect, the external impact force has been uniformly distributed to the structure body 30 and the second subsidiary foam filling body 22 to ensure the structure keeps integrated. In this case, the head of a wearer is fully protected.

Especially, the helmet structure or assembly 100 is able to bear external impact force and set up a multiplex system for buffering, absorbing and uniformly distributing and transmitting external impact force. The shell body 10 and the geometrical array texture structure 12 thereof bond with the first foam filling body 21 with lower foaming density to forma first-layer structure for providing better collapsing and distribution effect. The foam filling body 20 with higher foaming density forms a second-layer or middle-layer structure having sufficient structural strength or hardness to bear and resist against the distributed impact force. In addition, the structure body 30 and the geometrical array texture structure 32 thereof bond with the second foam filling body 22 with higher foaming density than the first subsidiary foaming filling body 21 to form a third-layer or innermost-layer structure for resisting against, distributing and transmitting the impact force and reducing or eliminating the uncomfortable feeling of a wearer.

In conclusion, in comparison with the conventional safety helmet, the integrally formed safety helmet structure of the present invention has the following advantages and characteristics:

1. The assembly of the shell body 10, the foam filling body 20 and the structure body 30 has been redesigned. For example, the shell body 10 and the structure body 30 respectively have the geometrical array texture structures 12, 32 and walls 13, 33 to form the solid cells 14, 34 arranged in form of a matrix. The foam material is permitted to enter and fill into the solid cells 14, 34 to form the first and second subsidiary foam filling bodies 21, 22. The first and second subsidiary foam filling bodies 21, 22 and the foam filling body 20 enclose and bond with each other to form a reinforcement structure. This is apparently different from the structure of the conventional safety helmet.
2. The integrated assembly of the shell body 10, the foam filling body 20 and the structure body 30 serves as a complex structure body for achieving more idealistic multiplex impact force buffering/absorption effect. Moreover, the helmet assembly of the present invention totally changes the distribution and transmission pattern of power (or external impact force) applied to the safety helmet. Therefore, the helmet assembly of the present invention obviously eliminates the shortcomings of the conventional safety helmet that the external impact force cannot be effectively distributed and transmitted to every region of the foam filling body and when impacted by external force, the foam filling body is easy to damage due to concentration of stress.
3. Especially, the structural design of the shell body 10, the geometrical array texture structure 12 of the shell body 10, the first subsidiary foam filling body 21, the foam filling body 20, the structure body 30, the geometrical array texture structure 32 of the structure body 30 and the second subsidiary foam filling body 22 meets the requirements of safety and low defect rate and provides an integrated structure with higher structural strength than the conventional safety helmet. In addition, the foaming density of the first subsidiary foam filling body 21, the foam filling body 20 and the second subsidiary foam filling body 22 is varied. (That is, the foaming density of the solid foam material progressively increases from the regions of the geometrical array texture structure 12 of the shell body 10 and the geometrical array texture structure 32 of the structure body 30 to the region of the foam filling body). Accordingly, the first subsidiary foam filling body 21, the foam filling body 20 and the second subsidiary foam filling body 22 together form a multilayer texture structure for providing gradually enhanced resistance against external collision or lateral impact pressure. Furthermore, the above structural design makes it possible to manufacture the helmet assembly 100 of the present invention in a much thinner and lighter form to widen the application range of the safety helmet.

In conclusion, the integrally formed safety helmet structure of the present invention is different from the conventional safety helmet in space form and is greatly advanced, inventive and advantageous over the conventional safety helmet.

The above embodiments are only used to illustrate the present invention, not intended to limit the scope thereof. Many modifications of the above embodiments can be made without departing from the spirit of the present invention.

What is claimed is:

1. An integrally formed safety helmet structure comprising an assembly of a shell body, a foam filling body enclosed in the shell body and a structure body, at least a portion of the foam filling body being positioned between the shell body and the structure body, the shell body having an inner face and a first geometrical array texture structure extending from the inner face of the shell body toward the foam filling body, the first geometrical array texture structure having multiple walls connected with each other to together define multiple solid cells, the structure body being defined by a second geometrical array texture structure, the second geometrical array texture structure having multiple walls connected with each other to together define multiple solid cells, a foam material filled in the solid cells of the first geometrical array texture structure foaming to form a first subsidiary foam filling body as an inner layer of the shell body, the first subsidiary foam filling body being bonded with the foam filling body, a cushion foam material filled in the solid cells of the second geometrical array texture structure foaming to form a second subsidiary foam filling body, the second subsidiary foam filling body being bonded with the foam filling body, wherein the shell body, the first subsidiary foam filling body forming the inner layer of the shell body, the structure body, the second subsidiary foam filling body and the foam filling body together forming an integrated helmet assembly.

2. The integrally formed safety helmet structure as claimed in claim 1, wherein the solid cells the first geometrical array texture structure of the shell body and the solid cells of the second geometrical array texture structure of the structure body have a configuration selected from a group consisting of triangular configuration, hexagonal configuration, polygonal configuration and circular configuration, the structure body being positioned in an innermost layer position of the assembly or positioned in a position where the structure body is enclosed by a portion of the foam filling body.

3. The integrally formed safety helmet structure as claimed in claim 2, wherein the solid cells the first geometrical array texture structure of the shell body have a depth larger than a depth of the solid cells of the second geometrical array texture structure of the structure body.

4. The integrally formed safety helmet structure as claimed in claim 3, wherein the foaming density of the foam material in the first geometrical array texture structure is such that the foaming density of the first subsidiary foam filling body progressively increases from the regions of the first geometrical array texture structure to the region of the foam filling body, and the foaming density of the cushion foam material in the second geometrical array texture structure is such that the foaming density of the second subsidiary foam filling body progressively increases from the regions of the second geometrical array texture structure to the region of the foam filling body.

5. The integrally formed safety helmet structure as claimed in claim 2, wherein the foaming density of the foam material in the first geometrical array texture structure is such that the foaming density of the first subsidiary foam filling body progressively increases from the regions of the first geometrical array texture structure to the region of the foam filling body, and the foaming density of the cushion foam material in the second geometrical array texture structure is such that the foaming density of the second subsidiary foam filling body progressively increases from the regions of the second geometrical array texture structure to the region of the foam filling body.

6. The integrally formed safety helmet structure as claimed in claim 1, wherein the foam filling body has a density larger than a density of the second subsidiary foam filling body and the density of the second subsidiary foam filling body is larger than a density of the first subsidiary foam filling body.

7. The integrally formed safety helmet structure as claimed in claim 6, wherein the solid cells the first geometrical array texture structure of the shell body have a depth larger than a depth of the solid cells of the second geometrical array texture structure of the structure body.

8. The integrally formed safety helmet structure as claimed in claim 7, wherein the foaming density of the foam material in the first geometrical array texture structure is such that the foaming density of the first subsidiary foam filling body progressively increases from the regions of the first geometrical array texture structure to the region of the foam filling body, and the foaming density of the cushion foam material in the second geometrical array texture structure is such that the foaming density of the second subsidiary foam filling body progressively increases from the regions of the second geometrical array texture structure to the region of the foam filling body.

9. The integrally formed safety helmet structure as claimed in claim 6, wherein the foaming density of the foam material in the first geometrical array texture structure is such that the foaming density of the first subsidiary foam filling body progressively increases from the regions of the first geometrical array texture structure to the region of the foam filling body, and the foaming density of the cushion foam material in the second geometrical array texture structure is such that the foaming density of the second subsidiary foam filling body progressively increases from the regions of the second geometrical array texture structure to the region of the foam filling body.

10. The integrally formed safety helmet structure as claimed in claim 6, wherein the structure body is a cap-shaped structure in the form of a hemispherical body, an annular subsidiary section being formed on a bottom of the structure body, the subsidiary section enclosing and connecting with a bottom of the foam filling body.

11. The integrally formed safety helmet structure as claimed in claim 10, wherein the subsidiary section is formed with an insertion channel for fixedly holding a bottom edge of the shell body, a recess being formed between an inner side of the subsidiary section and the foam filling body.

12. The integrally formed safety helmet structure as claimed in claim 6, wherein the foam filling body, the first subsidiary foam filling body and the second subsidiary foam filling body are formed of solid foam granules by means of heating and expanding the solid foam granules.

13. The integrally formed safety helmet structure as claimed in claim 1, wherein the solid cells the first geometrical array texture structure of the shell body have a depth larger than a depth of the solid cells of the second geometrical array texture structure of the structure body.

14. The integrally formed safety helmet structure as claimed in claim 13, wherein the foaming density of the foam material in the first geometrical array texture structure is such that the foaming density of the first subsidiary foam filling body progressively increases from the regions of the first geometrical array texture structure to the region of the foam filling body, and the foaming density of the cushion foam material in the second geometrical array texture structure is such that the foaming density of the second subsidiary foam filling body progressively increases from the regions of the second geometrical array texture structure to the region of the foam filling body.

15. The integrally formed safety helmet structure as claimed in claim 13, wherein the foam filling body, the first subsidiary foam filling body and the second subsidiary foam filling body are formed of solid foam granules by means of heating and expanding the solid foam granules.

16. The integrally formed safety helmet structure as claimed in claim 1, wherein the foaming density of the foam material in the first geometrical array texture structure is such that the foaming density of the first subsidiary foam filling body progressively increases from the regions of the first geometrical array texture structure to the region of the foam filling body, and the foaming density of the cushion foam material in the second geometrical array texture structure is such that the foaming density of the second subsidiary foam filling body progressively increases from the regions of the second geometrical array texture structure to the region of the foam filling body.

17. The integrally formed safety helmet structure as claimed in claim 1, wherein the structure body is a cap-shaped structure in the form of a hemispherical body, an annular subsidiary section being formed on a bottom of the structure body, the subsidiary section enclosing and connecting with a bottom of the foam filling body.

18. The integrally formed safety helmet structure as claimed in claim 17, wherein the subsidiary section is formed with an insertion channel for fixedly holding a bottom edge of the shell body, a recess being formed between an inner side of the subsidiary section and the foam filling body.

19. The integrally formed safety helmet structure as claimed in claim 1, wherein the foam filling body, the first subsidiary foam filling body and the second subsidiary foam filling body are formed of solid foam granules by means of heating and expanding the solid foam granules.

* * * * *